US005920742A

United States Patent [19]

Piccinino, Jr. et al.

[11] Patent Number: 5,920,742

[45] Date of Patent: Jul. 6, 1999

[54] NOZZLE ASSEMBLY AND A PROCESSING TANK AND METHOD FOR PROCESSING PHOTOSENSITIVE MATERIAL USING SAID NOZZLE ASSEMBLY

[75] Inventors: Ralph L. Piccinino, Jr., Rush; Thomas J. Brenner, Hilton, both of N.Y.

[73] Assignee: Eastman Kodak Company, Rochester, N.Y.

[21] Appl. No.: 08/995,959

[22] Filed: Dec. 22, 1997

[51] Int. Cl.[6] ..... G03D 3/02

[52] U.S. Cl. ..... 396/627; 396/626; 396/636; 239/76

[58] Field of Search ..... 396/626, 627, 396/636, 641; 239/76, 465; 118/300, 679

[56] References Cited

U.S. PATENT DOCUMENTS 4,688,917 8/1987 Muller et al. ..... 396/626
5,313,243 5/1994 Rosenburgh et al. ..... 396/626
5,339,131 8/1994 Rosenburgh et al. ..... 396/626
5,398,094 3/1995 Rosenburgh et al. ..... 396/626

*Primary Examiner*—D. Rutledge
*Attorney, Agent, or Firm*—David A. Novais

[57] ABSTRACT

A nozzle assembly includes a channel or tubular member that has openings or slots along its length to permit a passage of solution flowing within the channel or tubular member therethrough. A partition or splitter member is positioned within the channel or tubular member and has a cross-section that outwardly diverges in a direction from an inlet of the channel or tubular member to an end of the channel or tubular member downstream of the inlet. This serves to equalize a pressure of the solution along the length of the channel or tubular member as the solution exits the channel or tubular member through the openings. The nozzle assembly can supply processing solution to a processing path of a processing tank that processes photosensitive material and is structured so as to provide a uniform processing of the photosensitive material within the processing path.

20 Claims, 5 Drawing Sheets

NOZZLE ASSEMBLY AND A PROCESSING TANK AND METHOD FOR PROCESSING PHOTOSENSITIVE MATERIAL USING SAID NOZZLE ASSEMBLY

FIELD OF THE INVENTION

The present invention relates to the field of photoprocessing. More particularly, the present invention relates to a nozzle assembly as well as processing tank and method for processing photosensitive material utilizing the nozzle assembly.

BACKGROUND OF THE INVENTION

Photoprocessing vessels such as disclosed in a U.S. Pat. No. 5,339,131 utilize a rack and tank arrangement in which a rack is inserted within a tank to form a low volume processing vessel. That is, when the rack is inserted within the tank a space is formed therebetween for the passage of photosensitive material therethrough. The processing path as shown in U.S. Pat. No. 5,339,131 and other rack and tank arrangements are usually U-shaped and have a downward portion and an upward portion.

In cases where an emulsion side of the photosensitive material in the processing path faces the rack of a rack and tank arrangement, one method of supplying processing solution to the processing path involves providing a tubular member or nozzle assembly within the area of the rack. The tubular member or nozzle assembly includes openings or slots on opposing sides which provide processing solution to the downward portion and the upward portion of the processing path. However, there is a drawback with this arrangement in that processing solution supplied to the nozzle assembly will exit through slots at the inlet end of the nozzle assembly with a greater pressure than processing solution which exits at slots at the downstream end of the nozzle assembly. This provides for an uneven processing of photosensitive material which passes through the processing path in front of the slots of the nozzle assembly.

U.S. Pat. No. 5,313,243 suggests a narrowing of a processing path which leads to a slot nozzle. However, in the structure of the arrangement disclosed in U.S. Pat. No. 5,313,243, the openings or slots are only on one side of the slot nozzle. In a rack and tank arrangement as discussed above, the nozzle assembly supplies processing solution from opposing sides to both the upward and downward portion of the processing path. If the nozzle assembly were narrowed on one side, the result would be that the width of the processing path at the specific location where the nozzle assembly is narrowed (upward or downward portion) would be changed. This results in a non-uniform processing path along the upward and downward portions and would make it difficult to provide for uniform processing along both the upward and downward portions.

Additionally, in rack and tank arrangements which utilize a nozzle assembly in the area of the rack, at the start of a processing cycle when photosensitive material is first introduced into the processing tank, the photosensitive material first enters the downward portion of the processing path. As the photosensitive material passes in front of openings or slots of the nozzle assembly which face and supply processing solution to the downward portion of the processing path, there is no photosensitive material in the upward portion of the processing path. Therefore, the openings or slots of the nozzle assembly which supply processing solution to the upward portion of the processing path will not be facing photosensitive material. At this specific point of processing, some of the processing solution which flows in the nozzle assembly will be urged by the presence of the photosensitive material in the downward portion of the photoprocessing path out of the slots which face the upward portion of the photoprocessing path where no photosensitive material is present. This reduces the pressure of the solution applied to the photosensitive material through the slots which supply processing solution to the downward portion of the photoprocessing path. This can also occur at the end of a processing cycle when the photosensitive material is present in the upward portion of the processing path and not in the downward portion.

SUMMARY OF THE INVENTION

The present invention relates to a nozzle assembly that comprises a channel which includes openings along its length for permitting a passage of solution flowing within the channel therethrough; and a partition member positioned within the channel and having a cross-section which outwardly diverges in a direction from an inlet end of the channel to a downstream end of the channel downstream of the inlet end, to equalize a pressure of the solution along the length of the channel as the solution exits the channel through the openings.

The present invention also relates to a processing tank for use in a photoprocessor for processing photosensitive material. The processing tank comprises a processing path for permitting a passage of photosensitive material therethrough, and a tubular member having a plurality of openings along a length of the tubular member for introducing processing solution into the processing path. A partition member which has a cross-section that diverges in a direction from an inlet end of the tubular member to a downstream end of the tubular member which is downstream from the inlet end is positioned within the tubular member, to equalize a pressure along the length of the tubular member of the processing solution as the processing solution exits through the openings.

The present invention also relates to a method of equalizing a flow of solution that exits openings along a length of a tubular member. The method comprises the step of positioning a partition member within the tubular member so as to divide the tubular member into a first side and a second side, with the partition member having a cross-section that outwardly diverges in a direction from a first end of the tubular member to a second end of the tubular member downstream of the first end, so that a pressure of solution flow which exits a first opening of said openings at the first end of the tubular member will be substantially equal to a pressure of solution flow which exits a second opening of said openings at the second end of the tubular member.

The present invention also relates to a method of providing processing solution to a processing path of a processing tank which comprises the step of positioning a partition member within at least one channel located in the processing tank that delivers processing solution to the processing path. The channel has openings along its length which communicate with the processing path, and the partition member has a cross-section which outwardly diverges in a direction from an inlet end of the channel to a downstream end of the channel which is downstream from the inlet end. The method further comprises the step of supplying a processing solution to the channel such that the processing solution is lead by the channel to the processing path through the openings, wherein the partition member positioned within the channel equalizes a flow of solution which exits the openings along the length of the channel.

The present invention therefore provides for a tubular member, channel or nozzle assembly which includes a partition member positioned therein that acts as a flow splitter; and introduces a processing solution into a downward portion and an upward portion of a processing path of a processing tank. The partition member has a divergent cross-section which outwardly diverges from an inlet end so as to maintain an even pressure of solution as the solution exits slots or openings along the length of the tubular member, channel or nozzle assembly.

DETAILED DESCRIPTION OF THE INVENTION

Figure 1:
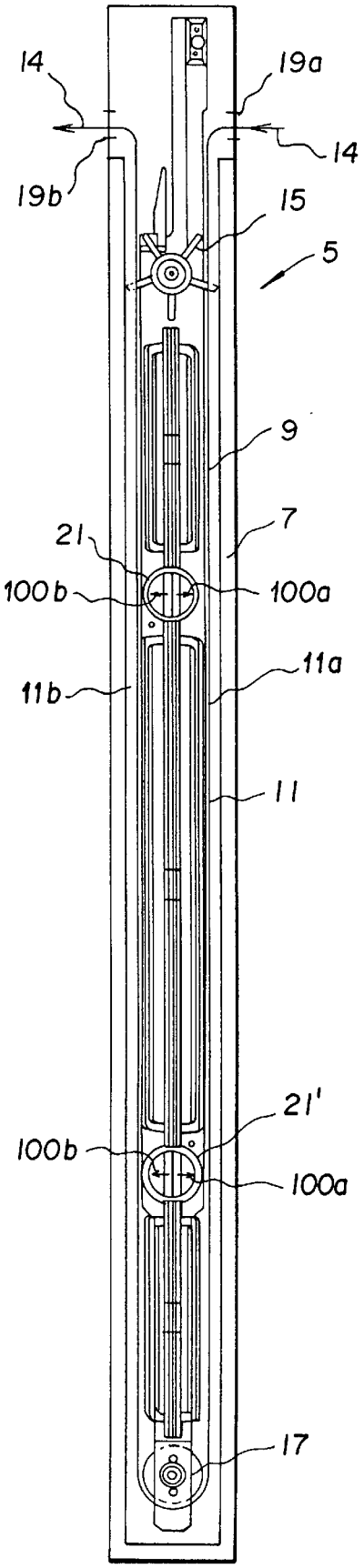
FIG. 1 illustrates a side view of a processing tank to which the nozzle assembly, channel or tubular member of the present invention is applicable.

Referring now to the drawings, wherein like reference numerals designate identical or corresponding parts throughout the several views, FIG. 1 shows a processing tank assembly 5 which makes up part of a photoprocessing assembly for processing photosensitive material. The processing of photosensitive material involves a series of steps such as developing, bleaching, fixing, washing and drying. These steps lend themselves to mechanization by conveying a continuous web of film or cut sheets of film or photographic paper sequentially through a series of stations or tank assemblies 5 such as disclosed in FIG. 1, each one containing a different processing solution appropriate to the process step at that station. Tank assembly 5 includes a tank 7 into which is inserted a rack 9. Rack 9 inserted within tank 7 forms a space that defines a processing path 11 through which a photosensitive material for processing passes. The passage of the photosensitive material through processing path 11 is illustrated in FIG. 1 by way of arrows 14.

Also shown in FIG. 1 is an entrance 19*a* through which photosensitive material for processing enters processing path 11. A guide roller 15 at a top portion of processing tank assembly 5 serves to guide photosensitive material from entrance 19*a* into a downward portion 11*a* of processing path 11. At the lower end of processing tank assembly 5 is a turnaround roller 17 which helps guide the photosensitive material to an upward portion 11*b* of processing path 11 and toward guide roller 15 which guides the photosensitive material to an exit 19*b* of processing tank assembly 5. A drive belt and clip arrangement (not shown) can be used to drive the photosensitive material through the tank assembly and around the rollers 15,17 in a known manner.

Processing tank assembly 5 further includes nozzle assemblies, channels or tubular members 21,21' which provide processing solution through openings or slots, which will be described later, in the direction of arrows 100*a*,100*b* respectively to downward portion 11*a* and upward portion 11*b* of processing path 11. Although two nozzle assemblies are illustrated, it is recognized that the number of nozzle assemblies is based on design considerations.

Figure 2:
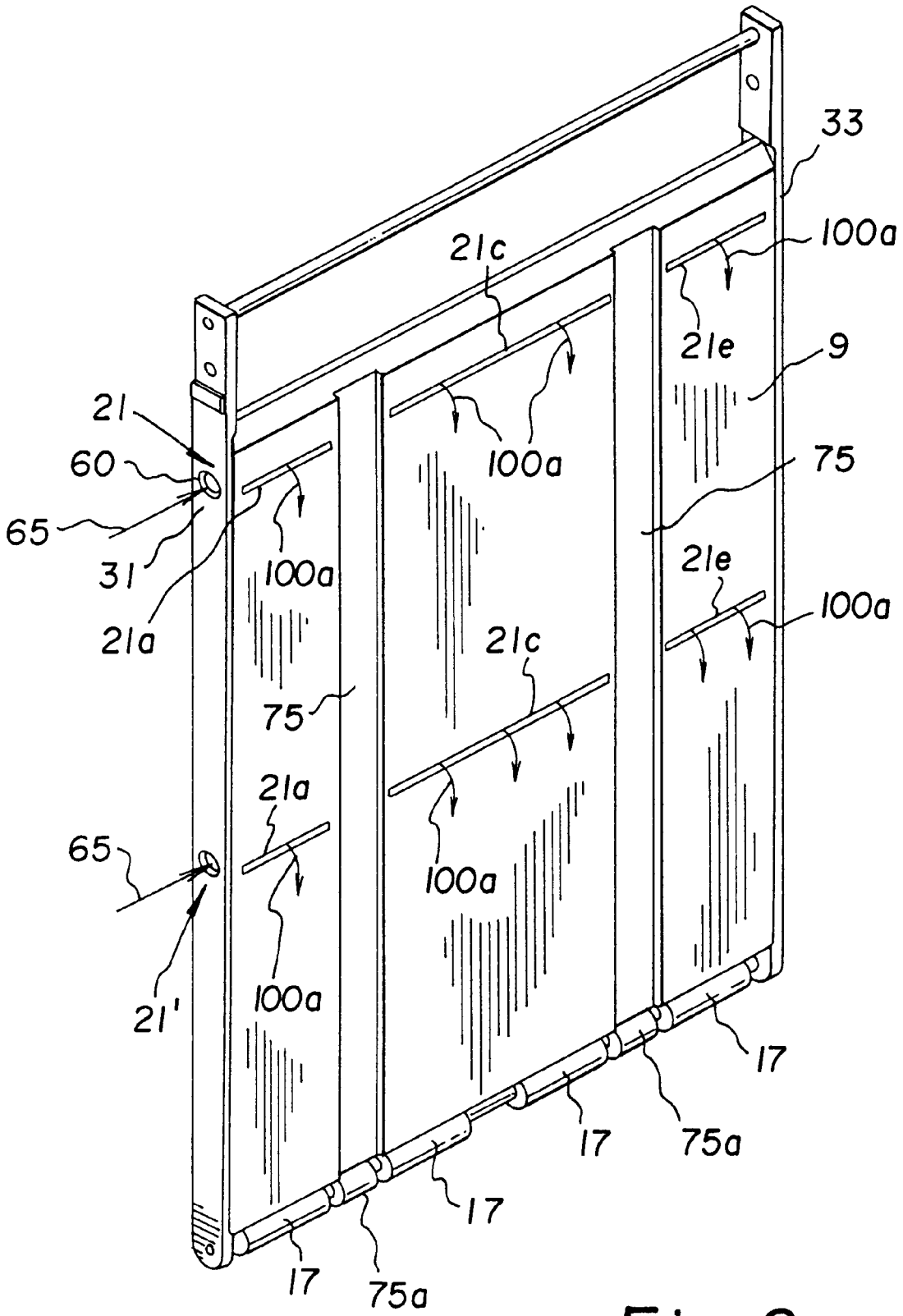
FIG. 2 is a perspective view of a rack which is positioned in the processing tank as shown in FIG. 1.

As more clearly shown in FIG. 2, which is a perspective view of rack 9, nozzle assemblies 21 and 21' are positioned in rack 9 so as to extend along a widthwise direction of rack 9. As also shown in FIG. 2, rack 9 includes grooves 75 through which the drive belt (not shown) runs, and a roller 75*a* around which the drive belt runs to drive the photosensitive material through processing path 11.

It is recognized that nozzle assemblies 21,21' are similar in structure and thus only one nozzle assembly 21 will be described. As noted in FIGS. 2–4, nozzle assembly 21 includes an inlet end 31, a first pair of opposing openings or slots 21*a*,21*b*, a second pair of opposing openings or slots 21*c*,21*d* downstream of the first pair of slots 21*a*,21*b*, a third pair of opposing openings or slots 21*e*,21*f* downstream of the second pair of slots 21*c*,21*d*, and a downstream end 33 which can be a closed end. The openings or slots 21*a*–21*f* can be but are not limited to elongated slots as illustrated in the figures. Openings 21*a*,21*c*,21*e* and 21*b*, 21*d*, 21*f* are respectively positioned so as to extend along a width-wise direction of processing path 11 and the photosensitive material passing in front of the respective openings. Although three pairs of openings or slots 21*a*,21*b*; 21*c*,21*d*; and 21*e*,21*f* are shown along the length of nozzle assembly 21, it is recognized that the number or pairs of openings or slots along the length of nozzle assembly 21 is based on design considerations.

Figure 3:
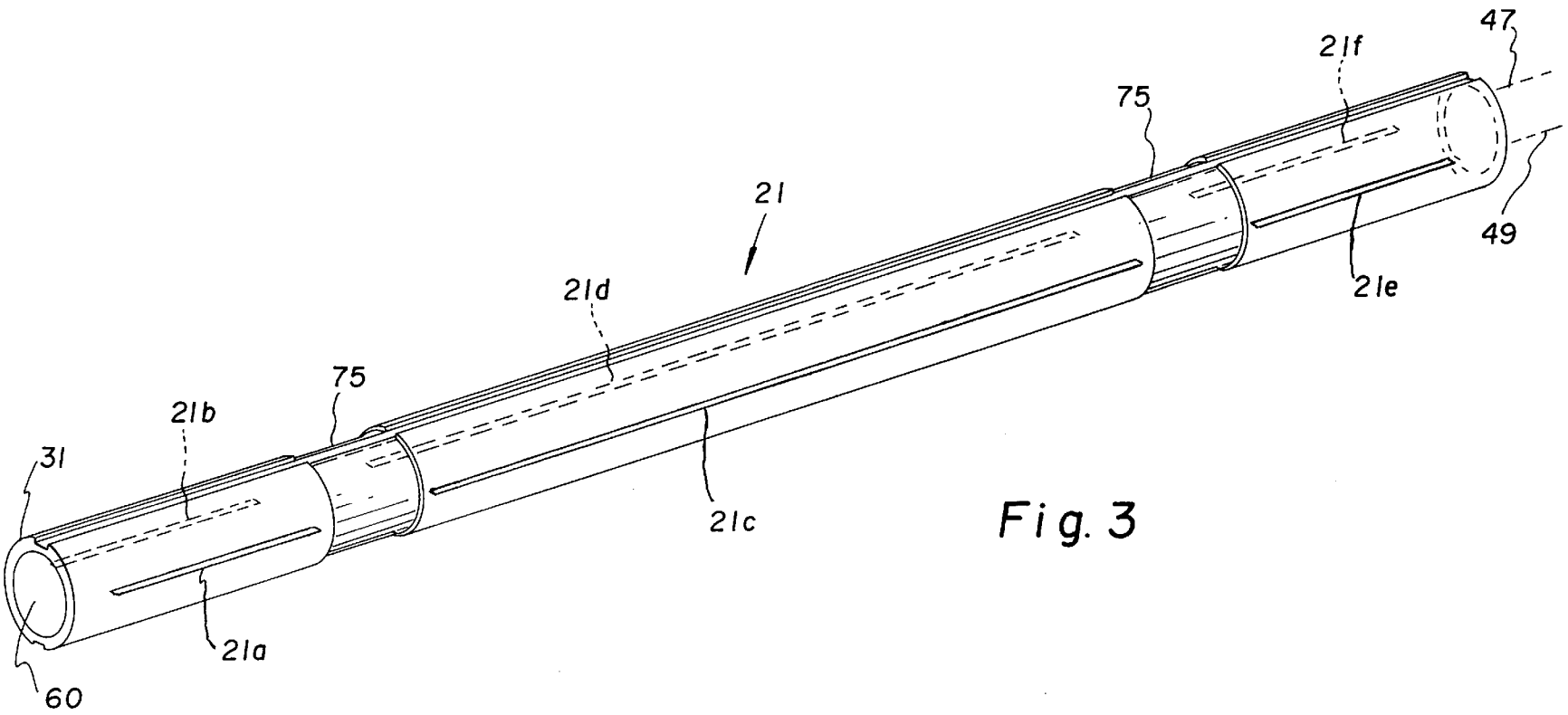
FIG. 3 is a perspective view of a nozzle assembly, channel or tubular member.
Figure 4:
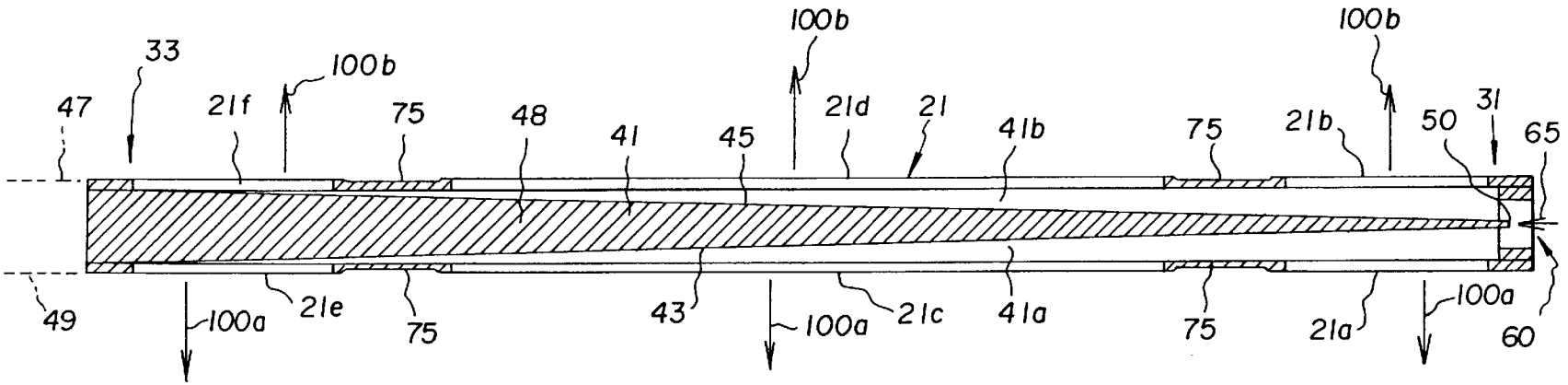
FIG. 4 is a top view of the nozzle assembly, channel or tubular member of the present invention showing the partition member positioned therein.

As illustrated in FIG. 4, nozzle assembly 21 includes a partition or splitter member 41 positioned therein. Partition member 41 has an outwardly diverging cross-section in a direction from inlet end 31 to downstream end 33 of nozzle assembly 21. When partition member 41 is positioned in nozzle assembly 21, nozzle assembly 21 is generally divided into first and second sides 41*a*,41*b* with openings 21*a*,21*c*, 21*e* positioned on first side 41*a* and extending along a plane defined along dashed line 49, and openings 21*b*,21*d*,21*f* positioned on second side 41*b* and extending along a plane defined along dashed line 47. As shown in FIGS. 3 and 4, the lines 49 and 47 are substantially parallel to each other such that the thickness of processing path 11 and the distance between the photosensitive material and openings 21*a*–21*f* whether on downstream portion 11*a* or upstream portion 11*b* are uniform.

Figure 5:
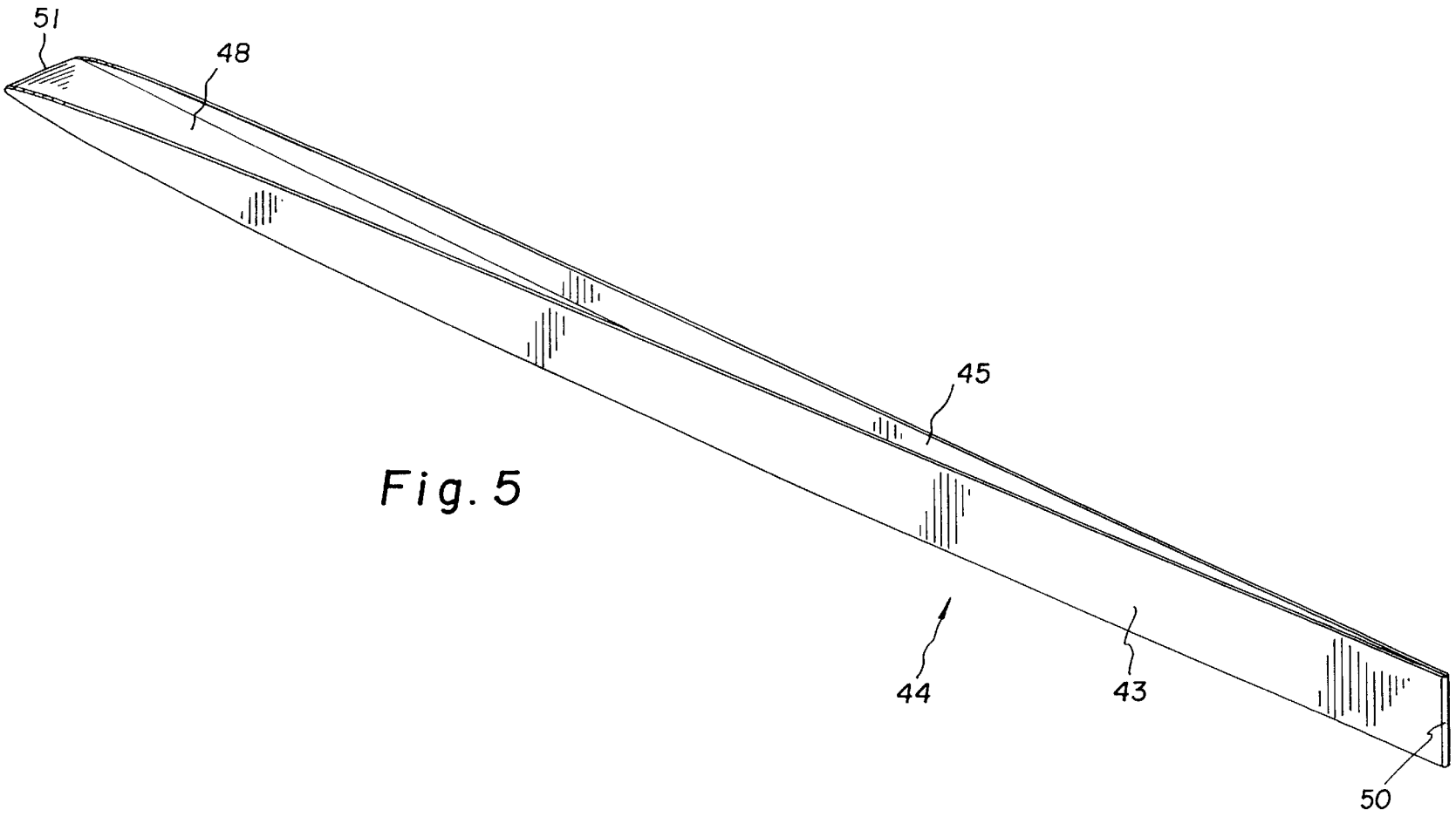
FIG. 5 is a view of an example of a partition member which can be utilized within the context of a present invention.

FIG. 5 illustrates an example of the type of partition member 41 which can be utilized within the context of the present invention. As illustrated in FIG. 5, partition member 41 can be an integral or single member which is formed to define a first member 43 and a second member 45 which meet along line 50 in the vicinity of inlet end 31 of nozzle assembly 21. Members 43 and 45 face each other and outwardly diverge in a direction toward downstream end 33 of nozzle assembly 21 as shown in FIG. 4. The formed partition member 41 also defines a member 48 which extends between first and second members 43 and 45 and outwardly diverges in a direction toward downstream end 33 of nozzle assembly 21. Therefore, in the vicinity of downstream end 33 of nozzle assembly 21, partition member 41 can form a second line 51 which is perpendicular to line 50. It is recognized that FIG. 5 only illustrates one example of partition member 41 which can be utilized within the context of the present invention, and that any partition member which provides for an outwardly diverging cross-section as illustrated in the figures can be utilized within the context of the present invention. It is further recognized that partition member 41 does not have to be formed from an integral member and can be composed of several members attached together through, for example, welding.

Referring now to FIGS. 1 and 4, the use of nozzle assembly 21 will now be described. As illustrated in FIG. 1, nozzle assembly 21 can be positioned within rack 9 and in between downward portion 11*a* and upward portion 11*b* of processing path 11. With this arrangement, nozzle assembly 21 provides processing solution to a facing or emulsion side of the photosensitive material in both downward portion 11*a* and upward portion 11*b* as shown by arrows 100*a*,100*b* via the openings 21*a*–21*f*. This arrangement provides processing solution to the photosensitive material as the photosensitive material passes in front of openings 21*a*–21*f*.

As illustrated in FIG. 4, processing solution is first introduced into nozzle assembly 21 via opening 60 at inlet end 31 in the direction of arrow 65. In the vicinity of inlet end 31, partition member 41 forms its smallest cross-section and outwardly diverges in a direction toward downstream end 33. Processing solution which exits openings 21*a*,21*b* and upstream sections of openings 21*c*,21*d* closer to inlet end 31 will have a sufficient pressure to apply processing solution in the directions 100*a*,100*b* to photosensitive material in downward portion 11*a* and upward portion 11*b* of processing path 11. As the processing solution flows further toward downstream end 33 of nozzle assembly 21, any pressure decrease in solution flow within nozzle assembly 21 will be offset by the increasing cross-section of partition member 41, so as to maintain or substantially equalize the pressure of the processing solution as it exits openings 21*e*,21*f* and downstream sections of openings 21*c*,21*d* closer to the vicinity of downstream end 33 of nozzle assembly 21. That is, the use of partition member 41 within nozzle assembly 21 assures that the pressure of the processing solution which exits openings 21*e*,21*f* and downstream sections of openings 21*c*,21*d* closer to the vicinity of downstream end 33 will be substantially equal to the pressure of the processing solution which exits openings 21*a*,21*b* and upstream sections of openings 21*c*,21*d* closer to inlet end 31. This arrangement assures a uniform processing along a widthwise direction of the photosensitive material in processing path 11.

Additionally, with the use of partition member 41 as illustrated in FIG. 4, there is no need to narrow nozzle assembly 21 to equalize pressure which would have the effect of increasing the width of the processing path 11. That is, a narrowing of nozzle assembly 21 would provide for a distance between opening 21*a* or 21*b* and the photosensitive material in processing path 11 which is smaller than a distance between opening 21*e* or 21*f* and the photosensitive material. This would make it difficult to provide uniform processing along the width of the photosensitive material since the processing solution will impinge on the photosensitive material with differing pressures.

Also, as previously described, partition member 41 divides the inside of nozzle assembly 21 into first side 41*a* and second side 41*b*. By having partition member 41 within nozzle assembly 21 as illustrated in FIG. 4, it is assured that openings 21*a*,21*c*,21*e* on first side 41*a* will be maintained in a plane along line 49 which is parallel to a plane along line 47 in which openings 21*b*,21*d*,21*f* on second side 41*b* are located. For example, the distance between opening 21*a* and the facing side of photosensitive material passing in front of nozzle assembly 21 in downward portion 11*a* will be equal to the distance between opening 21*c* and the facing side of the photosensitive material in downward portion 11*a*. This again assures a uniform distribution of processing solution and maintains a proper spacing between openings 21*a*–21*f* and the photosensitive material within processing path 11.

In a further aspect of the present invention, as illustrated in FIGS. 1 and 2, at the start of a processing cycle when photosensitive material is first introduced into processing tank assembly 5 via entrance 19*a*, the photosensitive material travels in front of the openings, for example, 21*a*,21*c*, 21*e* which face downward portion 11*a* of processing path 11. The same would apply to nozzle assembly 21' as the photosensitive material travels down downward processing path 11*a*. As previously described, nozzle assembly 21' has a similar structure to that of nozzle assembly 21. As processing solution is applied in direction 100*a* toward the photosensitive material in downward portion 11*a*, the processing solution will impinge on the facing side of the photosensitive material and some of the processing solution will be urged in a direction counter to direction 100*a* so as to abut against partition member 41 (FIG. 4); however, partition member 41 helps maintain the flow and pressure of processing solution in direction 100*a*. Without the presence of partition member 41, the flow which is urged counter to direction 100*a* will tend to exit unimpeded in direction 100*b* through the opposing openings 21*b*,21*d*,21*f* which would cause a reduction of pressure of solution that exits in direction 100*a*.

As the photosensitive material proceeds to turn-around roller 17 and heads up upward portion 11*b* of the processing path 11, the photosensitive material will face opposing openings 21*b*,21*d*,21*f*. The photosensitive material then will be treated via openings 21*b*,21*d*,21*f*. The presence of photosensitive material in front of openings 21*b*,21*d*,21*f* will cause a counter flow against the direction of arrow 100*b*; however, due to the presence of the partition member 41, the counter flow will not affect the flow in the direction of arrow 100*a* which, as described above, is used to treat photosensitive material which is in downward portion 11*a* of processing path 11. Therefore, partition member 41 of the present invention assures that a proper pressure of processing solution is maintained in the instance where only openings on one side of nozzle assembly 41 face the photosensitive material. Also, opposing flow directions 100*a*,100*b* of processing solution will not be affected by counter flows due to the presence of partition member 41 which divides nozzle assembly 21 into first and second sides 41*a* and 41*b*.

Accordingly, partition member 41 positioned within nozzle assembly 21 of the present invention maintains a uniform pressure from inlet end 31 to downstream end 33 so as to maintain a uniform pressure of solution exiting openings 21*a*–21*f*. At the same time, partition member 41 acts as a flow splitter so as to assure that solution flow which is applied to photosensitive material in downward portion 11*a* of processing path 11 will not be affected by solution flow which is used to treat photosensitive material in upward portion 11*b* of processing path 11. Additionally, through the use of partition member 41 within nozzle assembly 21, it is assured that the openings 21*a*,21*c*,21*e* on first side 41*a* of nozzle assembly 21 will be in plane 49 which is parallel to plane 47 which includes openings 21*b*,21*d*,21*f* on second side 41*b* of nozzle assembly 21. This assures a uniform spacing between the openings and the photosensitive material.

The invention has been described in detail with particular reference to certain preferred embodiments thereof, but it will be understood that variations and modifications can be effected within the spirit and scope of the invention.

What is claimed is:

1. A nozzle assembly comprising:

a channel including openings along its length for permitting a passage of solution flowing within said channel therethrough; and a partition member positioned within said channel and having a cross-section which outwardly diverges in a direction from an inlet end of said channel to a downstream end of said channel downstream of said inlet end, to equalize a pressure of the solution along the length of the channel as the solution exits the channel through said openings.

2. A nozzle assembly according to claim 1, wherein said openings are located on opposing sides of said channel to discharge solution through said openings in opposing directions, said openings extending on the opposing sides of the channel along planes which are substantially parallel to each other.

3. A nozzle assembly according to claim 1, wherein said partition member comprises a first part and a second part which face each other and diverge away from each other from the inlet end to the downstream end of the channel.

4. A nozzle assembly according to claim 1, wherein a cross-section of the partition member at the inlet end of the channel defines a first line which is perpendicular to a second line defined by a cross-section of the partition member at the downstream end of the channel.

5. A nozzle assembly according to claim 1, wherein said openings of said channel supply processing solution to a processing path of a processing tank which processes photosensitive material.

6. A nozzle assembly according to claim 5, wherein said processing path comprises a downward portion and an upward portion, such that the openings on the opposing sides of the channel respectively supply solution to the downward portion and the upward portion of the processing path.

7. A nozzle assembly according to claim 1, wherein said openings define elongated slots.

8. A processing tank for use in a photoprocessor for processing photosensitive material, said processing tank comprising:

a processing path for permitting a passage of photosensitive material therethrough; and a tubular member having a plurality of openings along a length of the tubular member for introducing processing solution into the processing path;

wherein a partition member having a cross-section which diverges from an inlet end of the tubular member to a downstream end of the tubular member which is downstream of said inlet end is positioned within the tubular member, to equalize a pressure along the length of the tubular member of the processing solution as the processing solution exits through said openings.

9. A processing tank according to claim 8, wherein said partition member divides said tubular member into a first side and a second side, and said openings comprise first openings which extend along the first side of the tubular member and second openings which extend along the second side of the tubular member and are substantially parallel to the first openings.

10. A processing tank according to claim 9, wherein said processing path comprises a downward portion and an upward portion, such that said first openings introduce processing solution into said downward portion and said second openings introduce processing solution into said upward portion.

11. A processing tank according to claim 8, wherein said openings define elongated slots.

12. A method of equalizing a flow of solution that exits openings along a length of a tubular member, the method comprising the step of:

positioning a partition member within the tubular member so as to divide the tubular member into first and second sides, said partition member having a cross-section which outwardly diverges in a direction from a first end of the tubular member to a second end of the tubular member downstream of the first end, so that a pressure of solution flow which exits an opening of said openings at the first end of the tubular member will be substantially equal to a pressure of solution flow which exits an opening of said openings at the second end of the tubular member.

13. A method according to claim 12, wherein said openings comprise first openings which extend along the first side of the tubular member and second openings which extend along the second side of the tubular member substantially parallel to the first openings, and said first and second openings lead solution into a processing path of a processing tank for processing photosensitive material.

14. A method according to claim 13, wherein said processing path comprises a downward portion and an upward portion, said first openings leading solution to the downward portion of the processing path and said second openings leading solution to the upward portion of the processing path.

15. A method according to claim 14, wherein said tubular member defines a nozzle assembly in which the first and second openings extend along a widthwise direction of the processing path and the photosensitive material passing therethrough.

16. A method according to claim 12, wherein said openings define elongated slots.

17. A method of providing processing solution to a processing path of a processing tank, the method comprising the steps of:

positioning a partition member within at least one channel located within said processing tank that delivers processing solution to the processing path, said channel having openings along its length which communicate with said processing path, said partition member having a cross-section which outwardly diverges in a direction from an inlet end of the channel to an end of the channel which is downstream from the inlet end; and supplying processing solution to the channel such that the processing solution is lead by the channel to said processing path through said openings, wherein said partition member positioned within said channel equalizes a flow of solution which exits the openings along the length of the channel.

18. A method according to claim 17, wherein said partition member divides said channel into a first side and a second side, and said openings comprise first openings which extend along the first side and second openings which extend along the second side substantially parallel to the first openings.

19. A method according to claim 18, wherein said processing path comprises a downward portion and an upward portion, said first openings leading solution to said downward portion and said second openings leading solution to said upward portion.

20. A method according to claim 17, wherein said openings define elongated slots.

* * * * *